United States Patent [19]

Schwarz

[11] 4,367,770

[45] Jan. 11, 1983

[54] ROTATIONAL DOBBY

[75] Inventor: Rudolf Schwarz, Horgen-Zuerich, Switzerland

[73] Assignee: Staeubli Ltd., Horgen-Zuerich, Switzerland

[21] Appl. No.: 177,159

[22] Filed: Aug. 11, 1980

[30] Foreign Application Priority Data

Aug. 16, 1979 [CH] Switzerland ..... 7500/79

[51] Int. Cl.[3] ..... D03C 1/00

[52] U.S. Cl. ..... 139/66 R; 139/76

[58] Field of Search ..... 139/66 R, 76, 77

[56] References Cited

U.S. PATENT DOCUMENTS

| | | | |
|---|---|---|---|
| 3,180,366 | 4/1965 | Hoenig | 139/66 R |
| 3,207,186 | 9/1965 | Hoenig | 139/66 R |
| 3,468,347 | 9/1969 | Fumat | 139/66 R |
| 3,724,511 | 4/1973 | Kleiner | 139/66 R |
| 3,726,323 | 4/1973 | Kleiner | 139/66 R |
| 3,730,231 | 5/1973 | Hoenig | 139/66 R |
| 3,730,232 | 5/1973 | Kleiner | 139/66 R |
| 3,804,128 | 4/1974 | Amiques | 139/66 R |

FOREIGN PATENT DOCUMENTS

| | | | |
|---|---|---|---|
| 595991 | 7/1959 | Italy | 139/76 |

*Primary Examiner*—Henry Jaudon

*Attorney, Agent, or Firm*—Blanchard, Flynn, Thiel, Boutell & Tanis

[57] ABSTRACT

A rotational dobby for use with weaving machines having plural heddle frames. The dobby has an eccentric disk for each heddle frame arranged side-by-side on a drive shaft with a coupling wedge movably installed therein, which coupling wedge effects a coupling and uncoupling of the eccentric disk relative to two recesses which are diametrically arranged on the shaft. A connecting rod is provided on the outer circumference of the eccentric disk and is coupled directly or through a rocking lever to an operating rod connected in turn to the heddle frame. A control mechanism is provided with pressure fingers which are movable in response to an information pattern on a pattern card.

12 Claims, 12 Drawing Figures

64
7
65

5
70
69
60
3
2
4
1
6
16
10
69
71
67
8

ROTATIONAL DOBBY

FIELD OF THE INVENTION

This invention relates to a rotational dobby of the general type illustrated in U.S. Pat. Nos. 3,180,366, 3,724,510, 3,724,511, 3,726,323, 3,730,231 and 3,730,232. In this arrangement, however, the desired operation, initiated by the pattern card, is independent of the position of the heddle frame and does not need specific structure to inform the dobby of the position of the heddle frame prior to an initiation of the desired operation.

BACKGROUND OF THE INVENTION

High demands are made of the lifting units which control the plurality of heddle frames in a weaving machine. Aside from the simple stepping devices, dobbies of the Hattersley system or lately rotational dobbies, for example U.S. Pat. No. 3,180,366, are primarily used for forming the shed. In the first case, the rectilinear movement of the heddle frames is caused by draw or push knives which move rectilinearly back and forth, which knives are suspended patternlike on controlled draw or holding hooks. The drive in rotational dobbies, on the other hand, occurs directly through a rotating drive shaft, on which through the motion of an eccentric a connecting rod is sequentially cyclically directly driven through the necessary back and forth movement. This facilitates the attainment of a higher speed, however, has the disadvantage that the actual control functions lead to problems.

For all stepping devices and dobbies there exists the condition that the dimension of the power-transmitting parts must lie within the width of the individual heddle frames, namely, within a space or pitch of 12 mm. In addition, it is important, for a general use of the two types of dobbies, that they can be controlled by an identical pattern card.

In the Hattersley dobbies, the controlled lifting members, for example draw hooks, are organized relatively spaciously in two separate planes in a double amount per heddle frame, for even and uneven picks. They are, during the control operation, at all times at the same point, which makes the control substantially easier. It is thereby not important which position the heddle frame is in.

The machine elements lie in rotational dobbies, due to the pitch, partially nested in one another, partially side-by-side. The actual coupling member, which must be sequentially controlled, in most cases a wedge, a pawl or a locking element, is embedded into or housed in an eccentric disk and becomes coupled or received in a groove in the drive shaft. This coupling member lies low or high, at two points which are offset at 180°, at the moment of the control, depending on the position of the heddle frame. That is, the coupling member must be controllable at each of these two points. The control signal which originates from a nonperforated or a perforated location on the pattern card must thereby be transmitted onto the wedge in relationship to the momentary heddle frame position. In other words: when the heddle frame is in the lower-shed position, a nonperforated location effects a "no engagement of the wedge", however, if the heddle frame is in the upper shed, the same nonperforated location means "effect an engagement of the wedge". In the first case, the heddle frame remains low and in the second case it will move down during the following half rotation of the shaft. The same law with reversed signs is valid for a perforated location in the card. This means, that one and the same reading of the pattern card, for example, a perforated location, a nonperforated location or a cam, result in a different control function, namely, a coupling or an uncoupling of the control member to or from the drive shaft.

German Pat. No. 1 410 724 illustrates a solution in which the control signal which originates at the card is acknowledged by a position indicator for indicating the heddle frame position or is changed in value. Such devices are very expensive and susceptible to breakdown.

The purpose of the invention is to provide a mechanism for transmitting the common control signals of different values in relationship to the position of the heddle frame onto the coupling part and without the help of a member which feeds back the heddle frame position.

This is achieved inventively with a dobby of the type mentioned above by movably securing a control member on the eccentric disk. The control member is operatively connected to the coupling wedge and has at least two control stops, which are in the base position of the shaft, in the region of at least one pressure finger of the control mechanism.

The new control member, which is associated with the eccentric disk and is movably connected to same, is moved directly in dependency of the momentary heddle frame position by the control elements so that the corresponding coupling and uncoupling occurs. The principal movement caused by the eccentric disk remains the same for the heddle frames. All elements are arranged within a spacing corresponding to the width of the individual heddle frames. The pattern card can be read with conventional means.

BRIEF DESCRIPTION OF THE DRAWINGS

Various embodiments of the subject matter of the invention are illustrated in the drawings, in which.

DETAILED DESCRIPTION

Figure 1:
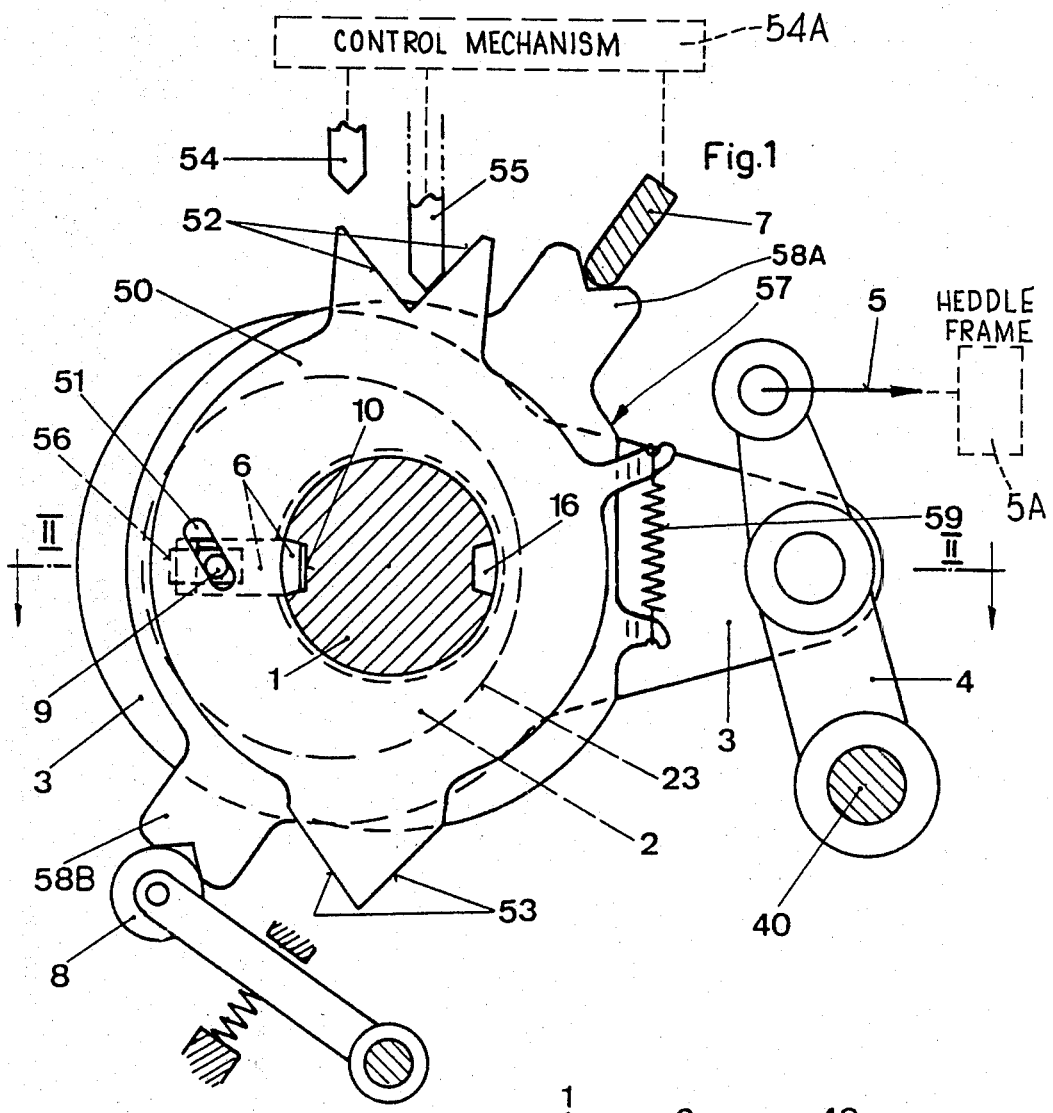
FIG. 1 illustrates in a first embodiment the most important elements of the mechanism, which initiates the controlled heddle frame movement, wherein the sequential control of the heddle frame is initiated by a rotating disk element, and the heddle frame is in the lower-shed position.

The principal design of a rotational dobby has been shown and discussed in various prior art patents. Reference is made particularly to U.S. Pat. No. 3,730,232 wherein a radially movable wedge is utilized as a coupling part, and Swiss Pat. No. 473 253 wherein a pawl is utilized as a coupling part. The heddle frame movement is thereby initiated by a continuously or an intermittently rotating drive shaft, on which shaft is mounted an eccentric disk carrying a connecting rod. Each half rotation of the shaft causes a movement of the heddle frame, in as far as the coupling part of the eccentric disk couples same with the drive shaft.

In each of the exemplary embodiments, the eccentric disk 2 is mounted on and rotatable with a rotatable drive shaft 1. The shaft 1 rotates intermittently through successive advances of 180° in synchronism with the operation of the weaving machine. The mechanism which synchronously rotates shaft 1 is conventional and well-known in the art and therefore has not been illustrated. The disk 2 is received in an opening 23 in the connecting rod 3. All elements are rotatable relative to one another. The connecting rod 3 is pivotally connected to a rocking lever 4 pivotally mounted on a fixed axle 40. A free arm of the rocking lever 4 engages an operating rod 5 which in turn is connected to a heddle frame 5A. Reference numeral 6 identifies a coupling wedge, which is supported for a sliding movement radially inwardly and outwardly in a groove in the eccentric disk 2. The nose on the wedge 6 is adapted to be received in diametrically opposed recesses or grooves 10,16 on the drive shaft 1. These basic elements are known and are the basis for every embodiment disclosed herein.

Figure 2:
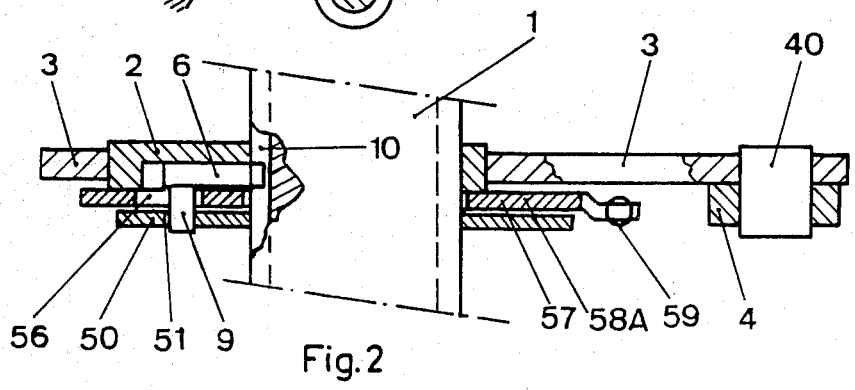
FIG. 2 is a cross-sectional view taken along the line II—II of FIG. 1.
Figure 3:
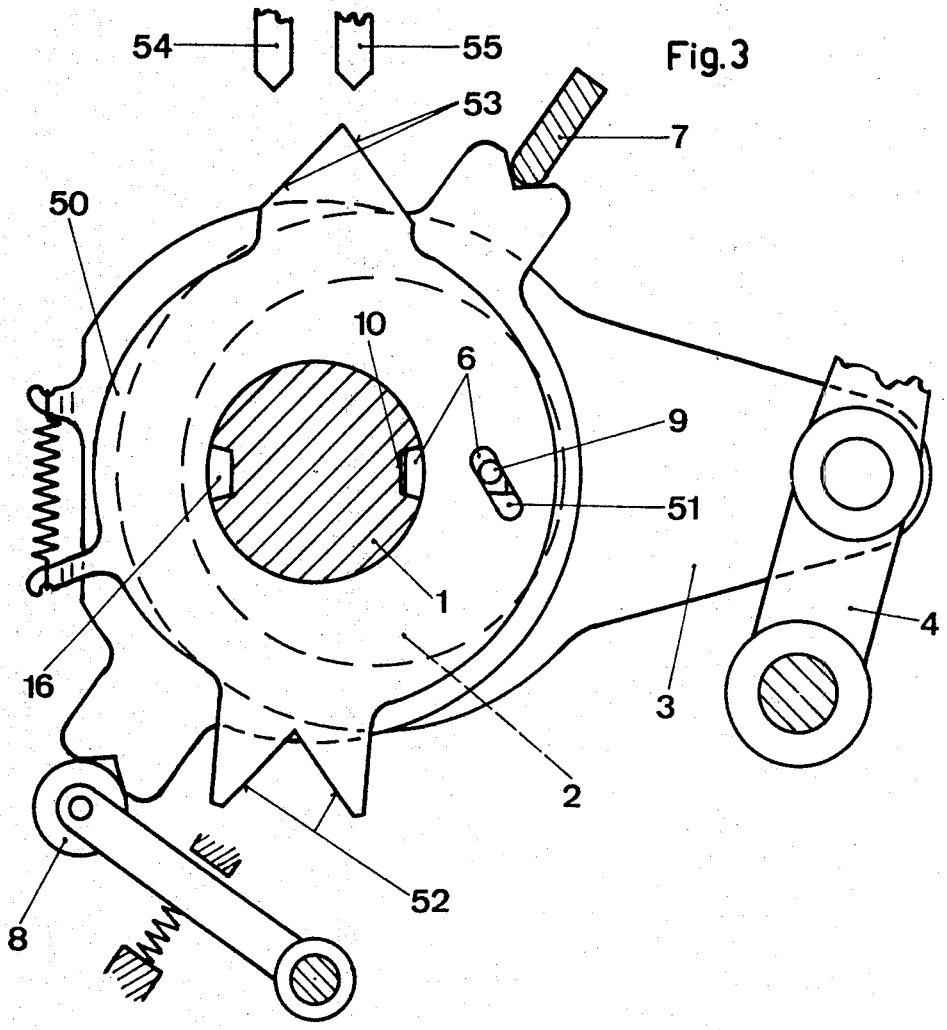
FIG. 3 illustrates the same mechanism in the upper-shed position of the heddle frame.

The mechanism according to FIGS. 1 to 3 includes as a control member a control disk 50 which is supported for limited relative rotation on the drive shaft 1. The control disk 50 is provided with a slot 51 therein functioning as a lead cam for an outwardly projecting bolt 9 on the wedge 6. The bolt 9 extends in a direction that is parallel to the axis of rotation of the shaft 1. The control disk 50 has two control stops which lie diametrically opposed to one another, wherein the one control stop is constructed as a V-shaped groove or notch with the two groove surfaces functioning as stop surfaces 52 and the other control stop is constructed as a V-shaped pointed projection with the two surfaces functioning as stop surfaces 53. The control disk 50 is operated through the use of two pressure fingers 54,55, which are part of a not shown control mechanism known to the man skilled in the art, for example a card-controlled needle works illustrated, for example, in U.S. Pat. No. 3,180,366. A further disk 57 having two notches 58A and 58B is fixedly connected to the eccentric disk 2. This further disk, in any conventional manner, such as by welds at least in the end position of the heddle frame, is operatively connected to a controlled locking member 7 or a spring-loaded roller 8. A spring 59 is tensioned between the disk 50 having the control stops 52,53 and the disk 57 having the notches 58A, 58B. As evident from FIG. 1, the tensioned spring 59 urges the disk 50 clockwise in FIG. 1 relative to the disk 57, the slot 51 cooperating with the bolt 9 so that the wedge 6 is urged radially inwardly, and will be urged into groove 10 or groove 16 in shaft 1 when angularly aligned therewith. The disk 57 having the notches 57A and 58A also has a rectangular window 56, through which the bolt 9 penetrates unhindered.

The position of the mechanism illustrated in FIG. 1 effects a holding of the heddle frame in the lower-shed position. If the heddle frame is to remain in the lower-shed position for the next pick insertion of the heddle frame—which according to the known pattern cards corresponds to a nonperforated location in the pattern card—the pressure finger 54 is moved forward by the reading mechanism. The finger 54 slides along the left stop surface 52 and effects a simultaneous rotation of the control disk 50 counterclockwise against the force of the spring 59. The bolt 9 which lies in the slot 51 and thus the wedge 6 is so moved from the groove 10 to the left. The previously coupled drive shaft 1 and eccentric disk 2 are now released and the drive shaft 1 rotates freely. The connecting rod 3 remains in the same position. A rotation of the control disk 50 under the influence of one of the pressure fingers 54,55 against the action of the spring 59 causes a counter-torque, which is preferably positively absorbed during the control operation with the help of the locking member 7 which is received in one of the notches 58A, 58B. The inclination of the slot 51 depends on the path of the pressure fingers 54,55 and the inclination of the stop surfaces 52,53.

If now for the next pick insertion the heddle frame is to reach the upper-shed position, this then corresponds to a perforated location on the pattern card. The pressure finger 55 moves into the groove and loads the right stop surface 52. The wedge 6 is—if this is not already the case—driven rightwardly into the groove 10 to the position illustrated in FIG. 1. After releasing the locking member 7, the drive shaft 1 carries the eccentric disk 2 and thus the disk 57 with the notches 58A, 58B and the control disk 50 along through the connection provided by the groove 10 and the wedge 6. This results in one attaining the position illustrated in FIG. 3. It is to be noted that now in place of the groove 52, the point 53 of the control disk 50 lies in front of the pressure fingers 54,55, so that a subsequent equal control movement of the pressure fingers has the opposite effect on the control disk or on the wedge. The heddle frame will remain in the upper-shed position, wherein the locking roller 8 locks the eccentric disk 2 in a fixed position during the rotation of the shaft.

At a read nonperforated location on the pattern card for a lower-shed position of the heddle frame, the left pressure finger 54 (FIG. 3) operates. It effects a rotation of the control disk 50 in a clockwise direction, which means engagement of the wedge 6. The eccentric disk 2 rotates with the drive shaft and the heddle frame is shifted downwardly.

In the case of a read perforated location on the pattern card for maintaining the heddle frame in the upper-shed position, the right pressure finger 55 operates. The pressure finger 55 effects a rotation of the control disk 50 in a counterclockwise direction. The bolt 9 slides to the right (FIG. 3) in the slot 51 and window 56 and pulls the wedge 6 from the groove 10. The eccentric disk 2 and thus the heddle frame remain unchanged in the upper-shed position.

Figure 4:
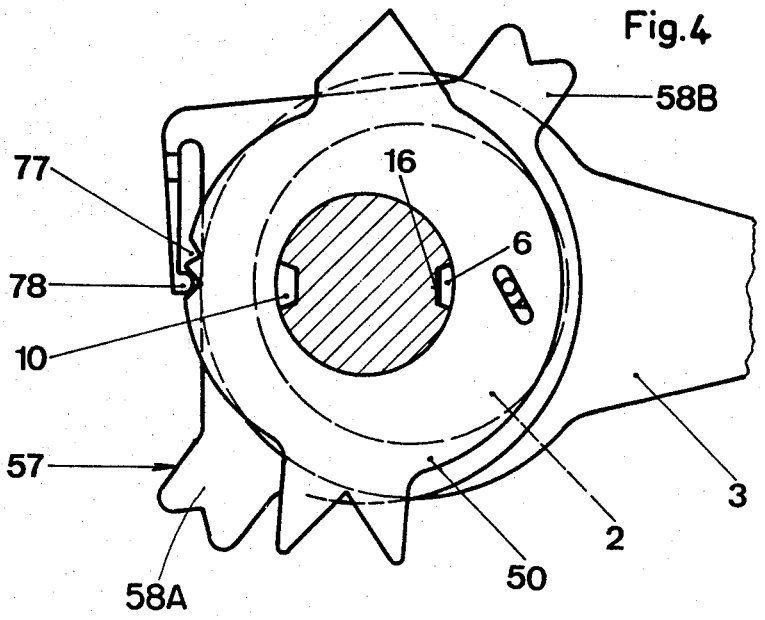
FIG. 4 illustrates a second embodiment.

FIG. 4 illustrates generally the same embodiment as discussed above with respect to FIGS. 1 to 3, with the difference, however, that the spring 59 between the control disk 50 and the disk 57 having notches 58A, 58B is replaced with laterally or radially facing indentations 77 in the control disk 50, in which indentations is received a tooth or pawl 78 resiliently supported on the disk 57.

In the embodiments which are illustrated in FIGS. 1 to 4, the control member 50 is rotated by the same control signals in one or the other direction, depending on the then present position of the heddle frame.

Figure 5:
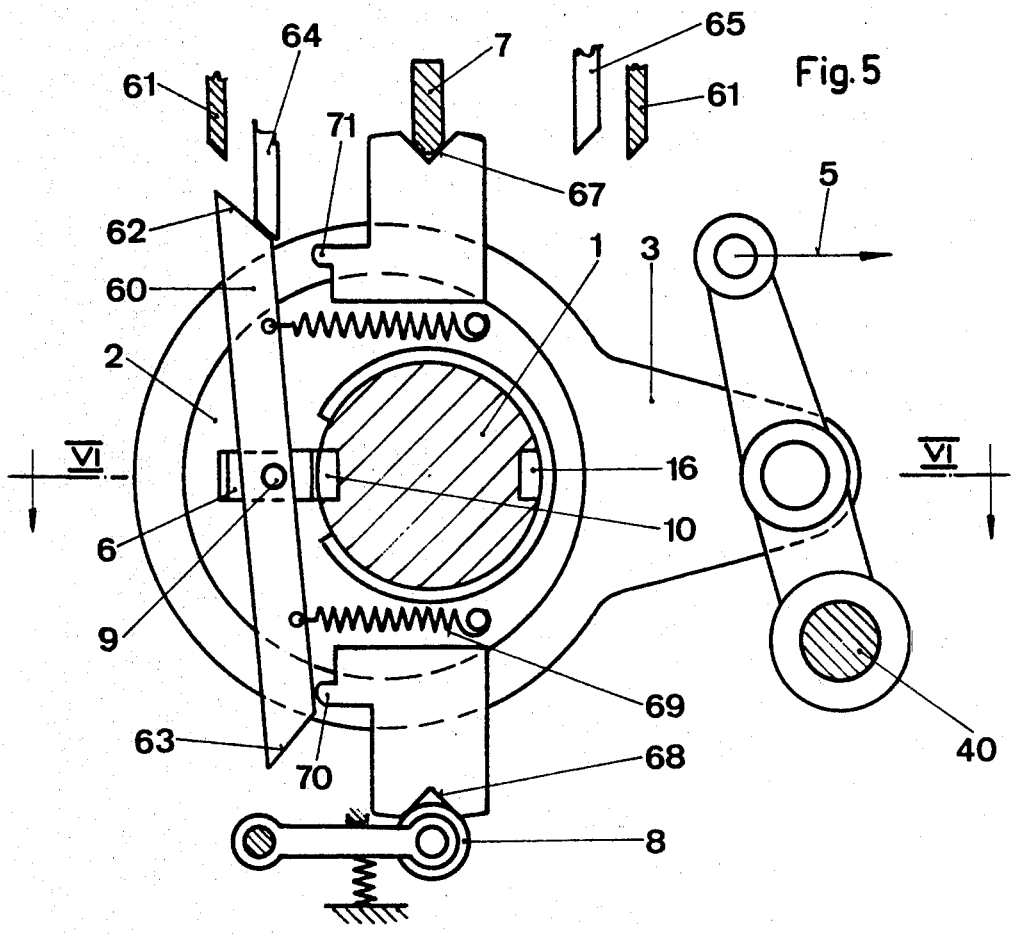
FIG. 5 illustrates a third embodiment in which the sequential control of the heddle frame is initiated by a swingable baulk element, and the heddle frame is in the lower-shed position.
Figure 6:
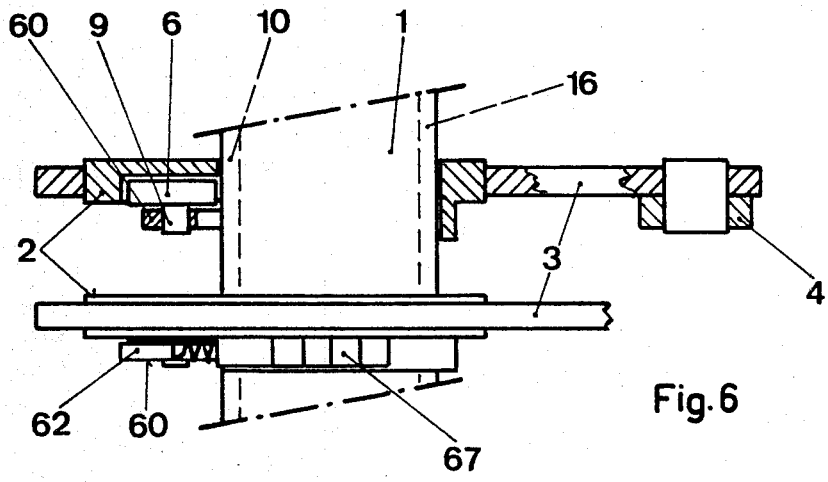
FIG. 6 is a cross-sectional view taken along the line VI—VI of FIG. 5.
Figure 7:
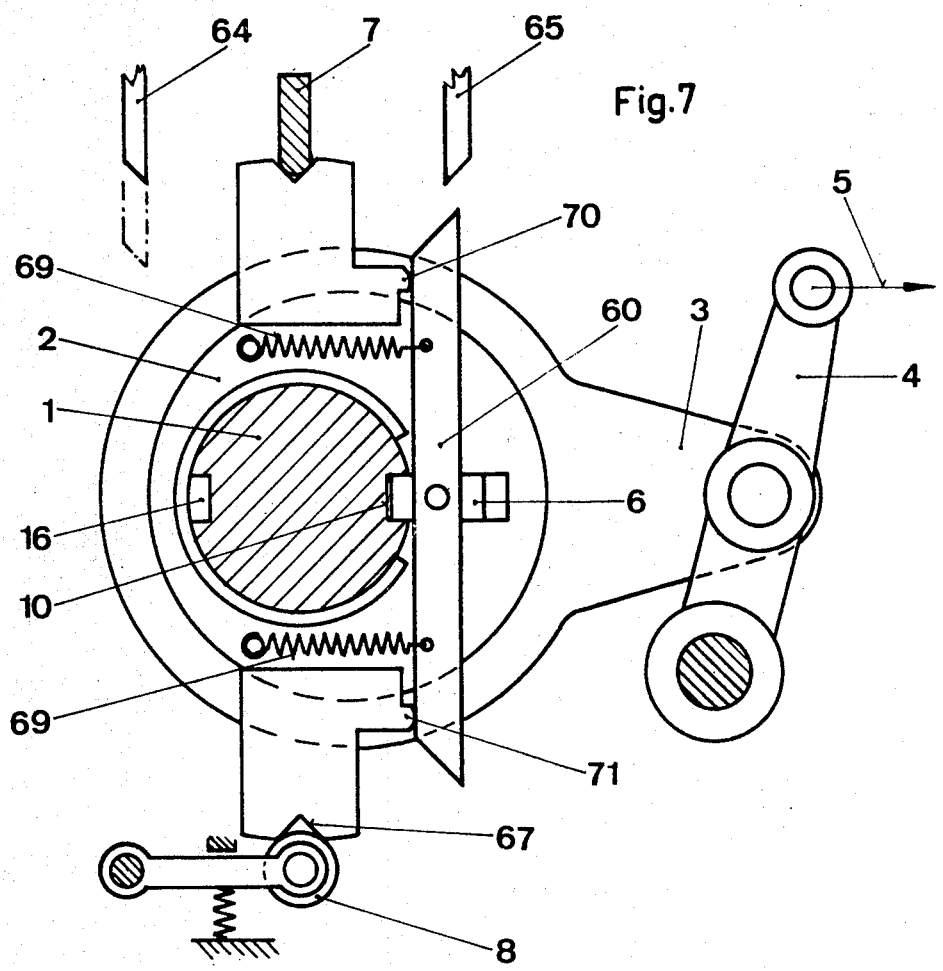
FIG. 7 illustrates the mechanism of FIG. 5 in the upper-shed position.
Figure 8:
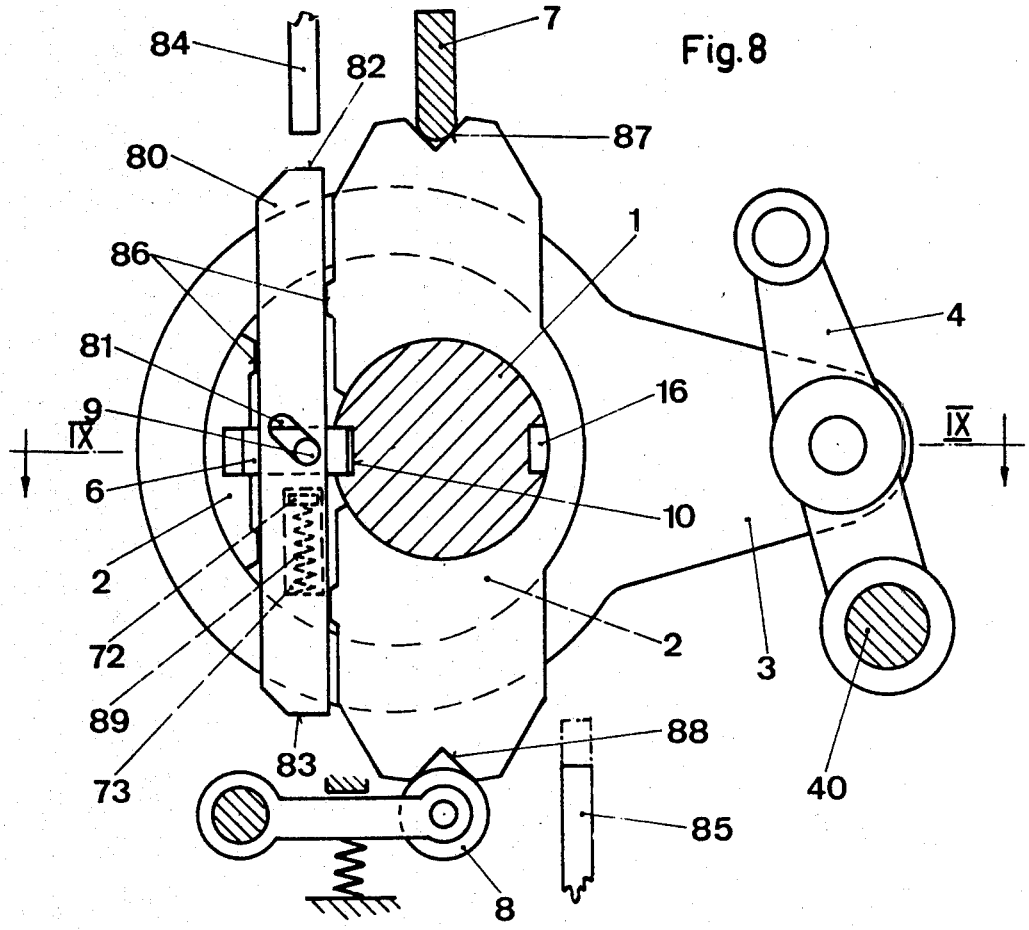
FIG. 8 illustrates a fourth embodiment, in which the sequential control of the heddle frame is induced by a slide element, and the heddle frame is in the lower-shed position.
Figure 9:
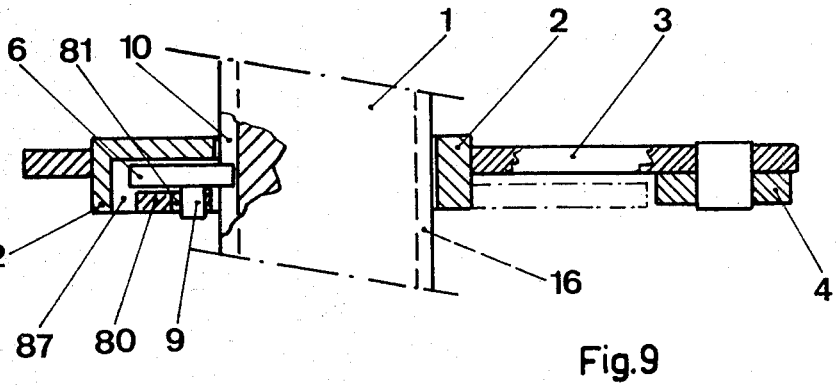
FIG. 9 is a cross-sectional view taken along the line IX—IX of FIG. 8.

The modified embodiment according to FIGS. 5 to 7 is characterized by the control member consisting of a balance beam 60, which is mounted at an angle of approximately 90° with respect to the direction of movement of the wedge 6. The main elements are the same. These are the drive shaft 1 with the diametrically opposed grooves 10,16, the eccentric disk 2, on which the connecting rod 3 is supported, and the rocking lever 4 which is pivotally supported on the axle 40 and which is coupled to the connecting rod 3. Reference numeral 5 identifies the operating rod for the heddle frame. Furthermore the coupling wedge 6 with the bolt 9 thereon is radially movably supported in the eccentric disk 2. Two lugs having notches 67,68 therein are secured to the eccentric disk 2. These notches receive during the control operation the locking member 7 and during standstill of the eccentric disk 2 the spring-loaded roller 8 to effect a securement of the position of the eccentric disk 2 against an unintended rotation.

The actual control mechanism initiates the movement or the standstill of the operating rod 5 depending on the initial position of the heddle frame, be it in the upper or lower-shed position. The control mechanism consists of an elongated balance beam 60 swingably supported on the bolt 9 of the wedge 6. A pair of springs 69 is coupled at one of the ends thereof to the beam 60 and at the other ends thereof to the eccentric disk 2 and effects a pulling of the beam until it rests against the stops 70,71 on the lugs attached to the eccentric disk. The two ends of the beam 60 have stop surfaces 62,63 thereon which are inclined with respect to the longitudinal extent of the beam and oppositely to one another.

Figure 11:
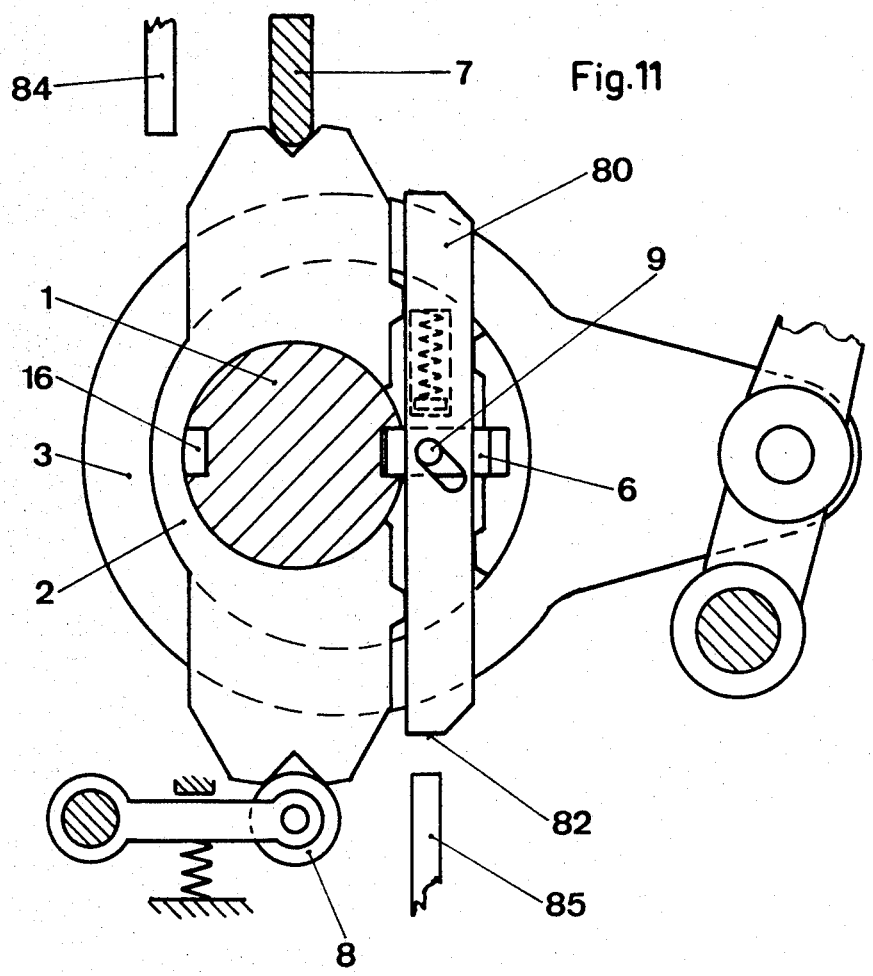
FIG. 11 illustrates the mechanism of FIG. 8 in the upper-shed position.

The balance beam 60 can also only be equipped with one single end, for example the one with the surface 62, wherein the corresponding control members 61,65, as in FIG. 11, must be arranged on the other side of the center line of the connecting rod from that shown in FIGS. 5 to 7.

A pair of pressure fingers 64,65 is arranged for the patternlike or sequential control of the operating mechanism for the corresponding heddle frame. The pressure finger 64 is moved forwardly, when the pattern card presents a nonperforated location to be read, namely, when the heddle frame is to remain in the lower-shed position or is to be moved into the lower-shed position. The first case is illustrated in FIG. 5, namely the pressure finger was in a control-like manner lowered. The stop surface 62 slides away from the pressure finger 64 in a counterclockwise direction and the beam 60 is, following the engagement of the end of the beam remote from the surface 62 with the stop 70, swung about an axis defined by the stop 70. The wedge 6 is at the same time pulled by the beam 60 acting on the bolt 9 to the left out of the groove 10 thereby uncoupling the drive shaft 1 and the eccentric disk 2. Since the pressure finger 64 is pulled back upon the start of the rotation of the drive shaft 1, the wedge would rest on the surface of the shaft and would slide therealong. To prevent this, a pair of locking knives 61 is arranged, which upon deviation of the beam 60 will lie on one of the stop surfaces 62,63 and will hold the beam in the swung-out or pivoted position, to keep the wedge in the lifted-off relationship with respect to the shaft. If the beam is not swung out, then the locking knife is cyclically lowered ineffectively behind the beam.

In order to assure that the described control does not initiate an undesired rotation of the eccentric disk, the roller 8 is received in the notch 68 under the urging of a spring, and during the moment of the control, the locking member 7 is additionally received in the notch 67. The roller 8 thereby cyclically secures the eccentric disk against an unintended rotation.

FIG. 7 illustrates the heddle-frame mechanism in the upper-shed position. If the heddle frame is to reach the lower-shed position, thus the nonperforated location of the pattern card is presented to the reader, then the pressure finger 64 is lowered. The beam 60 remains under the action of the springs 69 in the illustrated position. The drive shaft 1 takes along the eccentric disk 2 due to coupling provided by the wedge 6.

If, however, the pattern card has a perforated location presented to the reader, then the pressure finger 65 is lowered. The beam 60 in FIG. 7 is swung out clockwise about the axis defined by the stop 79, which causes the wedge 6 to shift to the right and unlock the eccentric disk 2 from the shaft 1 and cause the heddle frame to remain in the upper-shed position.

In the embodiment which is illustrated in FIGS. 5 to 7, the control member 60 is maintained by one and the same control signal either in its base position or is pivoted, depending on the preceding position of the heddle frame. In order to assure that the pressure load of the pressure fingers 64,65 does not act from the balance beam 60 through the bolt 9 onto the wedge 6, the balance beam can be provided with grooves, which grip over or straddle the stops 70,71, and the bolt 9 on the wedge is received in a slot in the balance beam. If the grooves are particularly effectively designed, it is possible for the balance beam to form one unit with the wedge, for which reason the slot for the wedge can be omitted.

The modified embodiments according to FIGS. 8 to 11 are characterized by the control member consisting of a slide member 80. The main elements are the same. These are the drive shaft 1 with the grooves 10,16 therein, the eccentric disk 2 on which is mounted the connecting rod 3, and the locking lever 4 which is pivotally supported on the axle 40 and which is pivotally coupled to the connecting rod 3. Furthermore, the coupling part or wedge 6 with the bolt 9 thereon is radially movably supported in the eccentric disk 2. Two lugs with notches 87,88 thereon are secured to the eccentric disk, which lugs are, depending on the position, engaged by the locking member 7 or the spring-loaded roller 8 to effect a securement of the position of the eccentric disk 2 against rotation.

The slide member 80, functioning as a control member of the moving mechanism, is slidably supported at a right angle with respect to the direction of movement of the wedge 6 in an off-center guideway 86 on the eccentric disk 2. The slide member 80 has a slot 81 therein (similar to the slot 51 in FIGS. 1 to 3) functioning as a lead cam for the bolt 9. Due to the force of the spring 89, which is supported at one end on a projection 72 on the eccentric disk 2 and at the other end on the end of a recess 73 in the slide member 80, the slide member is urged toward the position illustrated in FIG. 8. The heddle frame is in FIG. 8 in the lower-shed position. The two longitudinal ends of the slide member 80 serve as stop surface 82,83 for the pressure fingers 84,85 which are connected to the reading mechanism. The two pressure fingers lie in this embodiment on diametrically opposite sides of the drive shaft. The pressure finger 84 is moved in response to nonperforated locations on the pattern card and the pressure finger 85 is moved in response to perforated locations, all of which are detected and read on the card.

Figure 10:
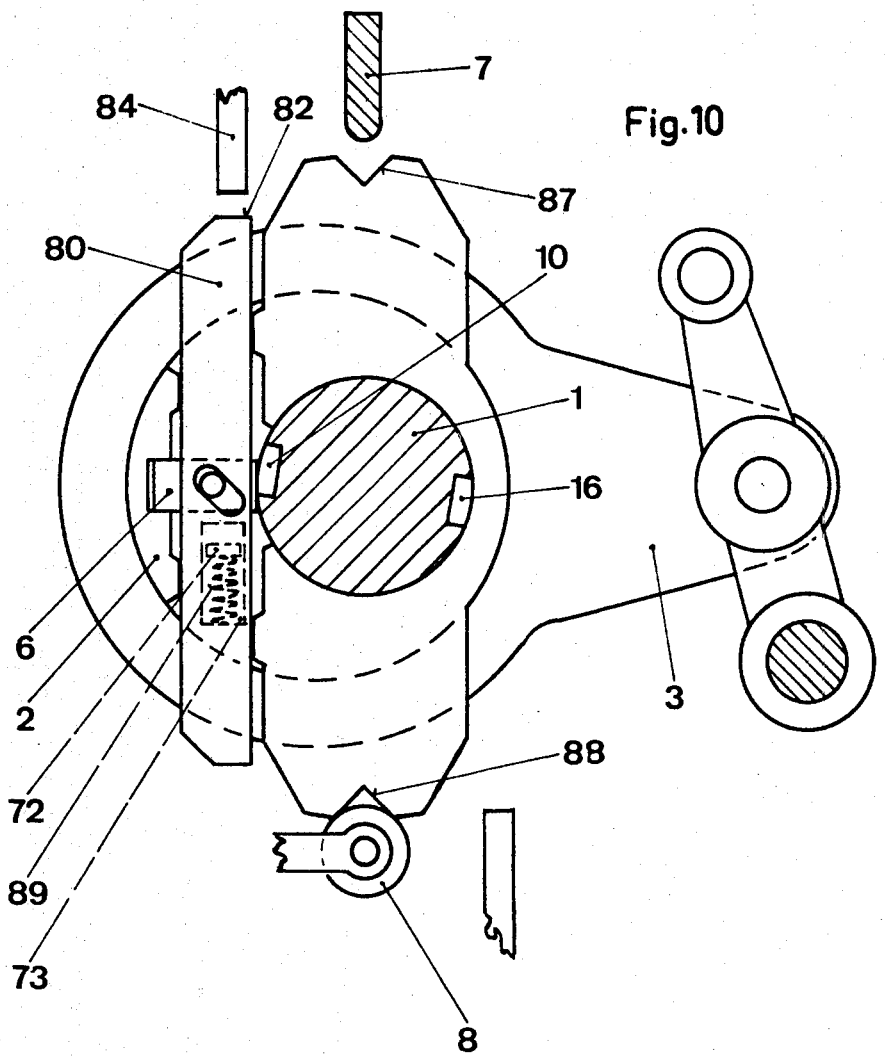
FIG. 10 illustrates the mechanism of FIG. 8 shortly after the control effecting a maintenance of the heddle frame in the lower-shed position.

If the heddle frame is to remain in the lower-shed position due to a nonperforated location on the pattern card being presented to the reading mechanism, then the pressure finger 84 urges the slide member 80 downwardly against the force of the spring 89. The bolt 9 slides to the left in the slot 81 and takes along the wedge to uncouple the eccentric disk from the shaft. The eccentric disk 2 cannot move, since it is positively held by the locking member 7 during the control operation. The drive shaft 1 rotates through 180° without taking along therewith the eccentric disk. FIG. 10 illustrates a partial rotation of the shaft from the position shown in FIG. 8. The pressure finger 84 is on its way into its base or initial position. The wedge 6 slides on the surface of the shaft 1. The eccentric disk cannot be taken along due to this friction, since it is held fixed by the roller 8. If the groove 10 or 16 becomes aligned with the wedge 6, same is again automatically received in the grooves 10,16 under the urging of the spring 89.

If the heddle frame is to be positioned in the upper-shed position, the pressure finger 85 (FIG. 8) is moved. The slide member 80 remains in its position and the drive shaft 1 takes along the eccentric disk through the coupling provided by the wedge 6. This results in one attaining the position according to FIG. 11.

Figure 12:
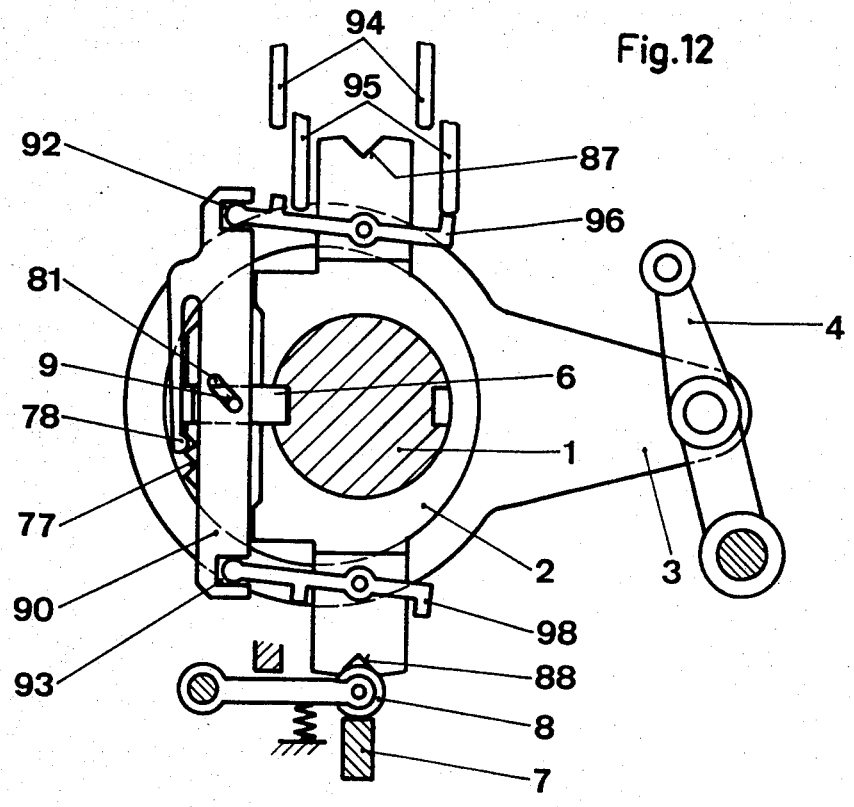
FIG. 12 illustrates a fifth embodiment with the slide element in the lower-shed position.

In certain cases, it is disadvantageous that the two pressure fingers lie on various sides of the drive shaft 1. FIG. 12 illustrates an embodiment according to FIG. 8, in which two pairs of pressure fingers 94,95 lie on the same side of the shaft. The ends of the slide member 90 have cutaway portions 92,93, into each of which is received one arm of a two-arm lever 96,98. The two-arm levers are each swingably supported on the eccentric disk 2 and each have two cam surfaces, against which can strike the pressure fingers to effect a movement of the slide member into two positions. These two positions of the slide member, which means an engagement or disengagement of the wedge 6 with or from the shaft, are secured by the resiliently supported tooth 78 which is received in the indentations 77. The advantage of the design incorporating the double levers 96,98 according to FIG. 12 compared with the designs according to FIGS. 8 to 11 consists among others in that the wedge 6 is controlled automatically and not with the help of a spring. With this the speed and the reliability of the operation can be notably increased particularly.

In the embodiments which are illustrated in FIGS. 8 to 12, the control member 80,90 is moved linearly by one and the same control signal, either in the one or in the other direction, depending on the preceding position of the heddle frame.

The control member, which is used in all examples, such as the control disk 50, balance beam 60, slide member 80,90, can also be replaced with a different control member. It is important that it, depending on the position of the eccentric disk 2, differently explains, correctly interprets the obtained patternlike control signals and effects the correct control movements, in order to move the heddle frame into the desired position or to lock same. The value reversal of the control signal occurs directly from the position of the eccentric disk 2 and is independent from a member which interrogates the momentary heddle-frame position and without the reverse-influence of the reading mechanism for the pattern card.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a rotational dobby for controlling at least one heddle frame in a weaving machine, including at least one eccentric disk which is rotatably supported on a drive shaft and has a coupling wedge supported thereon for movement into and out of selective engagement with two grooves provided on diametrically opposite sides of said shaft, a connecting rod supported on the outer circumference of said eccentric disk and means for operatively coupling said connecting rod to said heddle frame, a control mechanism having two movably supported pressure fingers, and a control member supported for movement relative to said eccentric disk and operatively coupled to said coupling wedge, the improvement comprising wherein said control member is a control disk which is supported for a limited amount of rotation on said drive shaft, said control disk having cam means slidingly engaging a bolt provided on said coupling wedge for effecting in response to rotation of said control member said movement of said coupling wedge into and out of engagement with said grooves in said shaft, and having two control stops which are diametrically opposed and are operatively engaged by said pressure fingers during movement thereof, each said control stop having two stop surfaces thereon inclined in opposite directions with respect to the direction of movement of said pressure fingers, whereby movement of a said pressure finger into engagement with one of said stop surfaces effects rotary movement of said control member.

2. The rotational dobby according to claim 1, wherein one said control stop is a notch, the surfaces of said notch being said stop surfaces thereon, and wherein the other said control stop is a pointed member, the exterior surfaces thereof being said stop surfaces thereon.

3. The rotational dobby according to claim 2, including a spring cooperable with said control member and said eccentric disk, which spring urges said control member to rotate relative to said eccentric disk.

4. The rotational dobby according to claim 1, including two diametrically opposed notches provided on said eccentric disk and engageable by a roller which is under spring pressure and by a movably supported locking member driven by said control mechanism.

5. The rotational dobby according to claim 1, wherein said cam means is constructed as a slot, in which is slidably received said bolt of said coupling wedge.

6. The rotational dobby according to claim 1, wherein at least two said pressure fingers are provided, lie parallel to one another and are selectively movable into engagement with said stop surfaces of said control member.

7. The rotational dobby according to claim 1, wherein said control member is provided with indentations which are engaged by a resiliently supported tooth.

8. In a rotational dobby for controlling at least one heddle frame in a weaving machine, including at least one eccentric disk which is rotatably supported on a drive shaft and has a coupling wedge supported thereon for movement into and out of selective engagement with two grooves provided on diametrically opposite sides of said shaft, a connecting rod supported on the outer circumference of said eccentric disk and means for operatively coupling said connecting rod to said heddle frame, a control mechanism having two movably supported pressure fingers, and a control member supported for movement relative to said eccentric disk and operatively coupled to said coupling wedge, the improvement comprising wherein said control member is a pivotally supported balance beam having two arms and a swivel axis which is a bolt on said coupling wedge, wherein said two arms of said beam are engaged by respective tension springs which are supported on said eccentric disk and pull said beam against two off-center lugs provided on said eccentric disk, and wherein each end of said beam has a stop surface engageable by said pressure fingers during movement thereof, said stop surfaces being inclined in opposite directions.

9. In a rotational dobby for controlling at least one heddle frame in a weaving machine, including at least one eccentric disk which is rotatably supported on a drive shaft and has a coupling wedge supported thereon for movement into and out of selective engagement with two grooves provided on diametrically opposite sides of said shaft, a connecting rod supported on the outer circumference of said eccentric disk and means for operatively coupling said connecting rod to said heddle frame, a control mechanism having two movably supported pressure fingers, and a control member supported for movement relative to said eccentric disk and operatively coupled to said coupling wedge, the improvement comprising wherein said control member is a slide member which is slidably supported off-center on said eccentric disk, has cam means which a bolt of said coupling wedge slidably engages for effecting in response to movement of said slide member said movement of said coupling wedge into and out of engagement with said grooves in said shaft, and wherein at least one end of said slide member is a stop surface engageable by said pressure fingers.

10. The rotational dobby according to claim 9, including a spring cooperable with said slide member and said eccentric disk which urges said slide member in a direction which effects movement of said coupling wedge toward said shaft.

11. The rotational dobby according to claim 10, including a pair of said pressure fingers which are movably supported on opposite sides of said shaft at locations aligned with operational positions of said stop surfaces on said slide member.

12. In a rotational dobby for controlling at least one heddle frame in a weaving machine, including at least one eccentric disk which is rotatably supported on a drive shaft and has a coupling wedge supported thereon for movement into and out of selective engagement with two grooves provided on diametrically opposite sides of said shaft, a connecting rod supported on the outer circumference of said eccentric disk and means for operatively coupling said connecting rod to said heddle frame, a control mechanism having two movably supported pressure fingers, and a control member supported for movement relative to said eccentric disk and operatively coupled to said coupling wedge, the improvement comprising wherein said control member is a slide member which is slidably supported on said eccentric disk, has cam means which a bolt on said coupling wedge slidably engages for effecting in response to movement of said slide member said movement of said coupling wedge into and out of engagement with said grooves in said shaft, and including rocker arms pivotally supported on said eccentric disk, operatively coupled to respective ends of said slide member, and having thereon stop surfaces operatively engageable by said pressure fingers.

* * * * *